US011725389B2

(12) United States Patent
Hicks et al.

(10) Patent No.: US 11,725,389 B2
(45) Date of Patent: Aug. 15, 2023

(54) ROOFING DEBRIS COLLECTION APPARATUS

(71) Applicants: Heath Austin Hicks, Tyler, TX (US); Eric James Mackintosh, Tyler, TX (US)

(72) Inventors: Heath Austin Hicks, Tyler, TX (US); Eric James Mackintosh, Tyler, TX (US)

( * ) Notice: Subject to any disclaimer, the term of this patent is extended or adjusted under 35 U.S.C. 154(b) by 0 days.

(21) Appl. No.: 16/939,924

(22) Filed: Jul. 27, 2020

(65) Prior Publication Data

US 2020/0354959 A1 Nov. 12, 2020

Related U.S. Application Data

(63) Continuation-in-part of application No. 16/404,780, filed on May 7, 2019, now Pat. No. 10,808,407, which is a continuation of application No. 16/156,796, filed on Oct. 10, 2018, now Pat. No. 10,724,246, which is a continuation-in-part of application No. 15/944,687, filed on Apr. 3, 2018, now Pat. No. 10,174,505.

(51) Int. Cl.
*E04D 13/076* (2006.01)

(52) U.S. Cl.
CPC ..... *E04D 13/076* (2013.01)

(58) Field of Classification Search
CPC ..... E04D 13/076; E04D 15/003; E04G 2021/248; E04G 21/30; B65G 11/103–106; B65G 11/163–166
See application file for complete search history.

(56) References Cited

U.S. PATENT DOCUMENTS

| | | | | |
|---|---|---|---|---|
| 2,072,415 | A | 3/1937 | Abbitt | |
| 2,271,081 | A | 1/1942 | Layton | |
| 2,583,422 | A | 1/1952 | Haddon | |
| 2,674,961 | A | 4/1954 | Lake | |
| 2,693,195 | A | 11/1954 | Frieder et al. | |
| 3,023,544 | A | 3/1962 | Hughes | |
| 3,295,264 | A | 1/1967 | Olson | |
| 3,325,038 | A * | 6/1967 | Ferney | E04D 13/08 52/11 |
| 3,352,581 | A | 11/1967 | Robbins et al. | |
| 3,367,070 | A | 2/1968 | Mitchell | |

(Continued)

FOREIGN PATENT DOCUMENTS

| | | | | |
|---|---|---|---|---|
| CH | 645151 | A5 * | 9/1984 | E04G 21/28 |
| EP | 2458113 | A1 * | 5/2012 | E04G 21/28 |
| GB | 2423777 | A | 9/2006 | |

*Primary Examiner* — Adriana Figueroa
(74) *Attorney, Agent, or Firm* — Standley Law Group LLP; F. Michael Speed, Jr.; Adam J. Smith

(57) ABSTRACT

Systems and methods for collecting roofing debris are provided. A number of support poles are provided, each of which are configured to rest against a wall of a structure being serviced. A debris collection chute comprising a number of attachment points spaced apart along an upper edge of the debris collection chute is also provided. Each of the support poles comprise an attachment device configured to selective engage one of the number of attachment points such that the debris collection chute is suspended in a vertical orientation at an angle from the wall.

17 Claims, 11 Drawing Sheets

(56) References Cited

U.S. PATENT DOCUMENTS 3,740,787 A * 6/1973 Bowermaster ..... E04D 13/076 15/105
3,913,284 A 10/1975 Hall
4,067,347 A 1/1978 Lipinski
4,089,127 A 5/1978 Maijala
4,173,101 A 11/1979 Van Wingerden
4,190,988 A 3/1980 Carreiro
4,190,998 A 3/1980 Keith
4,387,533 A 6/1983 Green et al.
4,406,093 A * 9/1983 Good ..... E04D 13/064 52/11
4,435,925 A 3/1984 Jefferys
4,445,301 A 5/1984 Tanski
4,596,093 A 6/1986 Esposito
4,878,322 A 11/1989 Ikeda et al.
4,915,439 A 4/1990 Cramaro
5,010,696 A 4/1991 Knittel
5,038,517 A 8/1991 Talbott
5,083,388 A 1/1992 Cooley
5,092,086 A 3/1992 Rognsvoog, Sr.
5,197,238 A 3/1993 Peleg
5,207,033 A 5/1993 Sells
5,241,977 A * 9/1993 Flores ..... E04H 15/58 135/88.06
5,268,969 A * 12/1993 Duran, Jr. ..... B65D 33/14 220/495.06
5,410,844 A 5/1995 Lynch
5,564,234 A 10/1996 Vermeulen
5,640,810 A 6/1997 Pietersen
5,864,990 A 2/1999 Tu
5,924,469 A * 7/1999 Whittemore ..... E04G 21/30 248/200.1
6,098,345 A 8/2000 Demartini et al.
6,113,340 A 9/2000 Zalal
6,209,615 B1 * 4/2001 Whittemore ..... A47H 21/00 160/368.1
6,321,823 B1 * 11/2001 Whittemore ..... A47H 21/00 160/368.1
6,357,510 B1 * 3/2002 Zheng ..... A63B 9/00 135/143
6,493,994 B1 12/2002 Lucas
6,508,295 B2 * 1/2003 Whittemore ..... E04G 21/24 160/368.1
6,572,945 B2 * 6/2003 Bries ..... A47G 1/175 428/40.1
6,640,502 B2 11/2003 Mueller
6,688,045 B1 2/2004 Pilcher
6,843,019 B2 1/2005 Mercurio et al.
7,240,458 B2 7/2007 Ishisaki
7,303,687 B2 12/2007 Groth et al.
7,314,078 B2 * 1/2008 Melino, Jr. ..... E04G 21/30 160/368.1
7,581,356 B1 9/2009 Balkum et al.
8,037,629 B2 * 10/2011 Harris ..... G09F 7/12 40/594
8,042,562 B1 10/2011 McDaniel, Jr.
8,069,617 B2 12/2011 Wootton
8,152,607 B2 4/2012 Carrig
8,166,712 B2 5/2012 Contreras
8,196,877 B2 * 6/2012 Gridley ..... E04H 15/60 248/516
8,297,000 B1 10/2012 Demartini
8,438,787 B2 5/2013 Lenney et al.
9,033,349 B2 5/2015 Graves et al.
9,359,139 B1 6/2016 Faulkner
9,506,268 B1 11/2016 Bright et al.
9,555,968 B2 1/2017 Seaton
9,642,315 B2 5/2017 Lloyd
9,657,514 B1 * 5/2017 Whittemore ..... E04G 21/241
9,689,166 B2 6/2017 Nelson
9,725,909 B2 * 8/2017 Ward ..... E04D 13/0765
9,963,882 B2 5/2018 Daneau
10,030,397 B2 * 7/2018 Stearns ..... E04G 21/3204
10,174,505 B1 1/2019 Hicks et al.
10,240,357 B2 * 3/2019 Cockerell ..... E04G 21/3266
10,329,091 B2 * 6/2019 Hogan ..... E04G 23/08
10,526,788 B2 * 1/2020 Mongelluzzo ..... F21V 33/006
10,669,722 B1 6/2020 Hicks et al.
10,781,597 B2 * 9/2020 Whittemore ..... E04G 21/243
2003/0037811 A1 * 2/2003 Altobelli ..... A47C 7/42 135/16
2004/0194418 A1 * 10/2004 Gouley ..... E04G 17/14 52/831
2004/0231208 A1 * 11/2004 Pitt ..... G09F 21/048 40/590
2005/0016076 A1 1/2005 Spradlin
2006/0130410 A1 6/2006 Isisaki
2008/0010906 A1 1/2008 Brochu
2008/0128030 A1 6/2008 Lewis
2008/0184629 A1 * 8/2008 Kruk ..... E04G 21/30 52/11
2008/0264460 A1 * 10/2008 Hentschel ..... E04H 15/003 135/91
2009/0314321 A1 * 12/2009 Van Dyken ..... A01G 20/43 135/95
2010/0024325 A1 2/2010 Robbins et al.
2010/0287846 A1 11/2010 Lenney
2012/0091116 A1 4/2012 Casey
2012/0144759 A1 6/2012 Higginbotham et al.
2012/0267909 A1 * 10/2012 Sandel ..... A01G 20/43 294/137
2019/0010704 A1 * 1/2019 Mongelluzzo ..... E04D 13/0765

* cited by examiner

ROOFING DEBRIS COLLECTION APPARATUS

CROSS-REFERENCE TO RELATED APPLICATIONS

This application is a continuation-in-part of U.S. application Ser. No. 16/404,780 filed May 7, 2019, which is a continuation of U.S. application Ser. No. 16/156,796, filed on Oct. 10, 2018, which is a Continuation-in-Part of U.S. application Ser. No. 15/944,687, filed on Apr. 3, 2018, the disclosures of each of which are incorporated herein by reference as if fully restated herein.

FIELD OF THE INVENTION

Exemplary embodiments relate generally to systems and methods for safely and efficiently delivering materials and debris from roof structures.

BACKGROUND OF THE INVENTION

In the roofing trades, it is often necessary to completely remove an existing roof structure prior to replacement with a new roof. This procedure involves the tear off and removal of the roof materials such as asphalt coatings, shingles, roofing paper, asbestos, plywood and other materials, which must be delivered to a dump truck at ground level for disposal. If these materials are simply dropped off the side of the roof, they can damage the side of the building or damage other structures such as shrubs, flowers, and bushes. In conventional practice a collection bin is placed on the roof or various chute systems have been devised to remove debris from the roof surface and deliver it to a dump truck. However, such conventional systems have inherent drawbacks and are difficult to manage. Collection bins have to be hoisted onto the roof and moved to different areas of the roof Likewise chutes that extend from the edge of the roof to the ground have to be moved from position to position around the perimeter of the roof. An easier and quicker system would be an apparatus that allowed discarding of debris into the gutters and over the edge of the roof which, at the same time, was safe and provided an efficient collection of the debris.

Roofers often use branded vehicles, clothing, yard signs, and the like when performing roofing work as a form of advertising. However, such signage is generally small and difficult to read. Furthermore, roofing companies may change names and logos over time or sell equipment to another company. Therefore, what is needed is a roofing debris collection system which permits the integration of selectively removable signage.

SUMMARY OF THE INVENTION

The present invention is roofing debris collection apparatus having one or more gutter liners, one or more debris chute drapes, and one or more drape support poles maintaining the debris chute drapes in a vertical orientation adjacent the gutter. The gutter liner has a U-shaped or V-shaped lip on the front of the gutter liner. The U-shaped or V-shaped lip is constructed to fit over a front edge of a gutter. The drape support poles have a pole tip support for engaging the side of a building. The pole tip support has a support portion having a pole connecting portion and a debris chute drape connecting portion. The pole tip support also has a protective cover.

One or more drape support poles are positioned vertically at an angle on the side of the building adjacent the gutter, wherein the drape support poles extend from beneath the gutter to the ground. One or more debris chute drapes are attached to the drape support poles vertically at an angle adjacent the gutter, wherein the drape support poles extend from beneath the gutter towards the ground.

In an alternative embodiment of the gutter liner, the gutter liner is adjustable, having a first portion with a U-shaped or V-shaped lip on a front of the first portion and having a second portion with a U-shaped or V-shaped lip on a front of the second portion. The second portion is adjustably inserted into the first portion and the U-shaped or V-shaped lip on the second portion fits over the U-shaped or V-shaped lip on the first portion.

In another alternate embodiment the gutter liner has a plurality of spaced apart debris collecting cups. The debris collecting cups are attached to a first side of a U-shaped or V-shaped lip. An opposite side of the lip is constructed to fit over a front side of a gutter.

In another alternative embodiment of the gutter liner the gutter liner has a U-shaped or V-shaped lip extending from a front side and from a top of the gutter liner. The gutter liner has one or more connectors positioned in an interior of the gutter liner on the front side for connecting to a debris chute drape.

The gutter liners of the present invention can be used adjacent to a gutter cover for directing roofing debris from a roof, over a gutter, and directly onto a debris chute drape. The gutter cover consists of a cover plate and brace member on its bottom surface.

The invention provides a method for collecting roofing debris, comprising the steps of inserting one or more gutter liners into a gutter attached to a roof; positioning one or more debris chute drapes vertically on one or more poles adjacent the gutter; allowing roofing debris to accumulate in the one or more gutter liners or to fall on to one or more debris chute drapes and to fall from the one or more debris chute drapes onto the ground or onto a debris collecting ground tarps; and collecting the roofing debris from the gutter liners and from the ground or from the debris collecting ground tarp. The invention also provides a kit for collecting roofing debris. The kit has one or more gutter liners constructed to fit in an interior of a gutter; one or more debris chute drapes; and one or more drape support poles for maintaining the debris chute drapes in a vertical orientation adjacent the gutter. The kit can also include a gutter cover and a debris collecting ground tarp with handles.

An advantage of the present invention is a roofing debris collection apparatus that can be rapidly installed around the perimeter of a roof.

Another advantage is a roofing debris collection apparatus that is compact, easy to transport and assemble, and inexpensive to construct.

Another advantage is a roofing debris collection apparatus that allows for rapid collection and removal of roofing debris.

Another advantage is a roofing debris collection apparatus that protects the sides of a building from any damage that might be caused by the collection of roofing debris.

Another advantage is a debris chute drape made of netting that allows air exchange.

Another advantage is a debris collecting ground tarp having handles to facilitate lifting and carrying the debris collecting ground tarp when it is full of roofing debris.

A roofing debris collection system which permits the integration of selectively removable signage is provided.

Fasteners may be provided at various locations of the debris chute drape. The fasteners may be configured to mate with the signage such that the signage may be prominently displayed while the debris chute drape is installed at a job site. In exemplary embodiments, areas of hook and loop fasteners are provided at various locations along the debris chute drape. Hook and loop fasteners may be provided at corresponding areas of the signage. The signage may be removable for storage, changing out, replacement, repair, some combination thereof, or the like.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE INVENTION

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1:
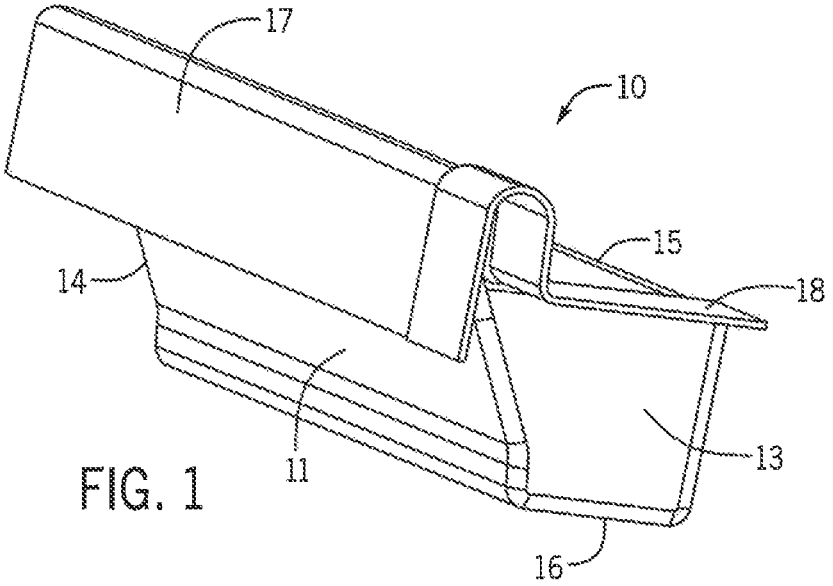
FIG. 1 shows a front perspective view of a gutter liner of the present invention.
Figure 2:
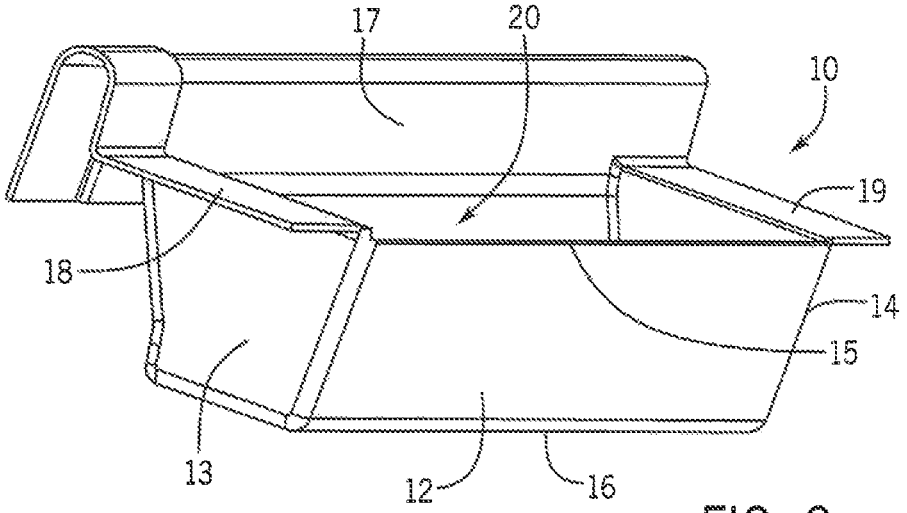
FIG. 2 shows a rear perspective view of the gutter liner.

FIG. 1 shows a front perspective view of a gutter liner 10 of the present invention. The gutter liner 10 has a front side 11, a rear side 12 (see FIG. 2), a first end 13, a second opposite end 14, a top 15 and a bottom 16. A lip 17, preferably a U-shaped or V-shaped lip, extends from the front side 11, top 15 of gutter liner 10. FIG. 2 shows a rear perspective view of the gutter liner 10. The gutter liner 10 has a support member 18 on a first end of the gutter liner 10 and a support member 19 on a second opposite end of the gutter liner 10. FIG. 2 further shows an interior 20 of the gutter liners 10 for collecting roofing debris.

Figure 3:
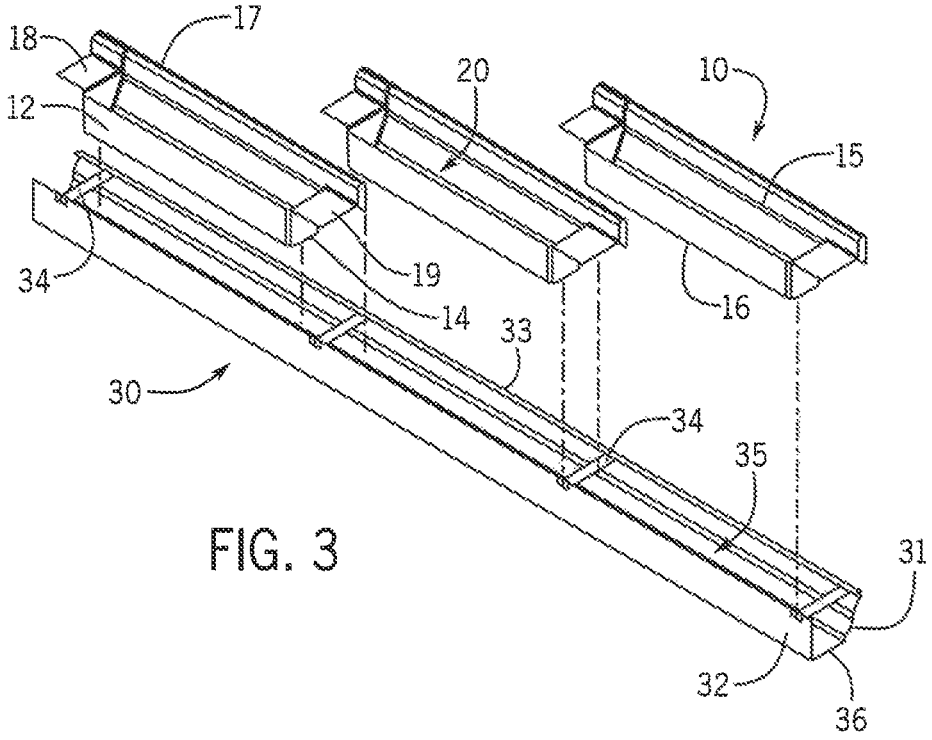
FIG. 3 shows a rear perspective view of a plurality of gutter liners positioned over a gutter.
Figure 4:
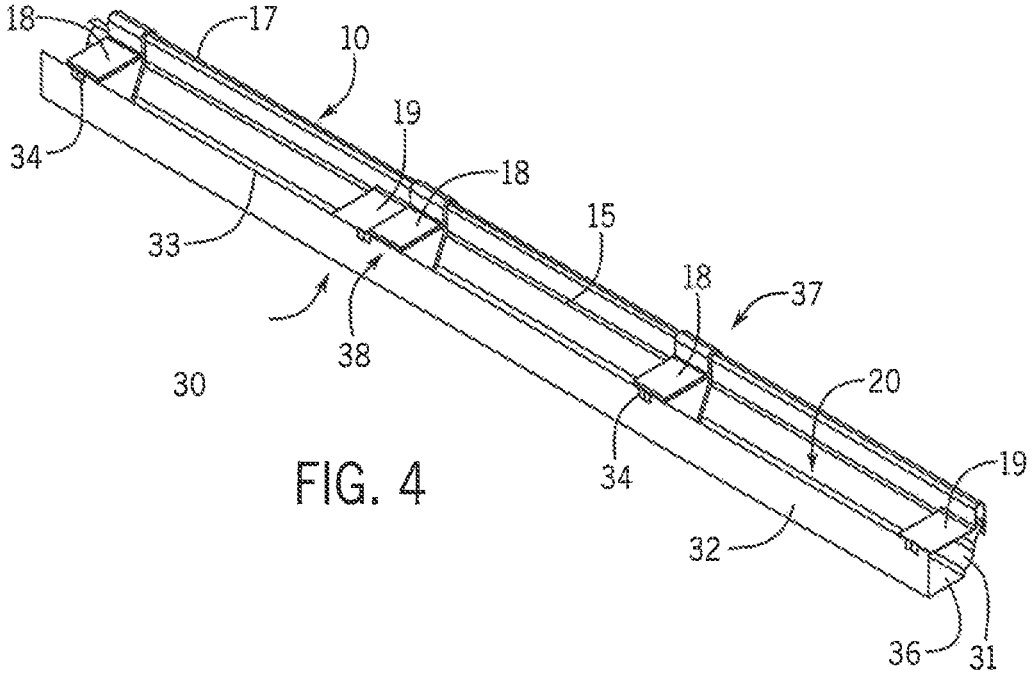
FIG. 4 shows a rear perspective view of the plurality of gutter liners positioned in the gutter.

FIG. 3 shows a rear perspective view of a plurality of gutter liners 10 positioned over a gutter 30. The gutter 30 has a front side 31, a rear side 32, a top edge 33, a bottom 36, and an interior 35. The gutter 30 also has mounting straps 34 which fasten the gutter 30 to a roof FIG. 4 shows a rear perspective view of the plurality of gutter liners 10 inserted into the interior 35 of gutter 30. The lips 17 of the gutter liners 10 are configured to fit over the front side 31, top edge 33 of the gutters 30. The support members 18 and 19 are configured to fit over the mounting straps 34 and the support member 18 is configured to fit over the support member 19 or adjacent to it. At position 37 the support member 18 is positioned over the support member 19 which is positioned over a mounting strap 34. At position 38 the support member 18 is adjacent to or partially overlaps the support member 19. The support members 18 and 19 may also extend over the rear side 32, top edge 33 of the gutter 30. When the gutter liners 10 are inserted into the interior 35 of gutter 30 they are in position to receive debris from a roof.

Figure 5:
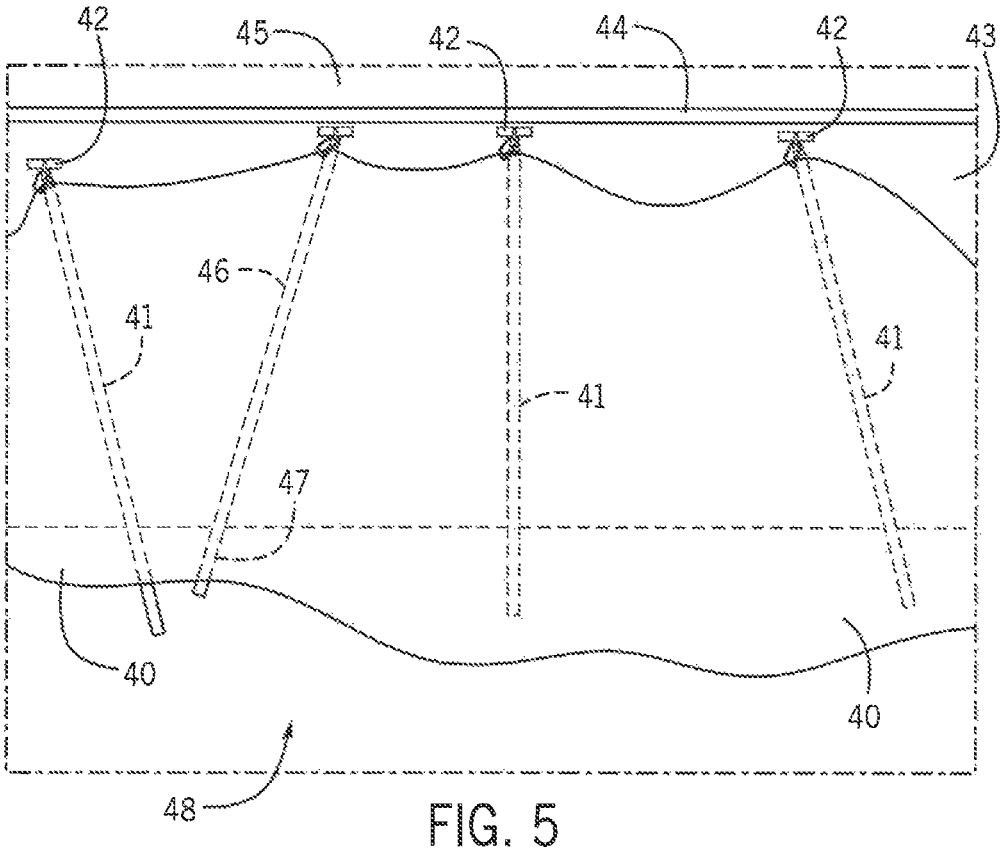
FIG. 5 illustrates debris chute drapes of the present invention positioned on drape support poles adjacent to a gutter on a roof.

FIG. 5 illustrates debris chute drapes 40 of the present invention positioned on drape support poles 41 adjacent to a gutter 44 on a roof 45 of a building. The drape support poles 41 have a top end 46 and a bottom end 47. The top end 46 has a pole tip support 42 (topper) that engages the side of a house 43. The pole tip support 42 maintains the position of the top end 46 of the drape support poles 41 against the side of the house 43. The drape support poles 41 are positioned vertically at an angle against the side of the house 43 and the bottom end 47 of the drape support pole 47 engages the ground or a debris collecting ground tarp 48 on the ground.

The debris chute drapes 40 are connected to the pole tip supports 42, are draped across the drape support poles 41 vertically at an angle and extend towards the debris collecting ground tarp 48 so as to act as a chute. The debris collecting ground tarp 48 can have handles 49 (see FIG. 10) to facilitate lifting and carrying the debris collecting ground tarp 48 for debris disposal.

The debris chute drapes 40 can be made of any suitable materials known in the art. The debris chute drapes 40 can be made of flexible plastic, textile, or netting material such that roofing debris will slide down the debris chute drapes 40 as it would, for example, down a chute. Preferably, the debris chute drapes 40 are made of a netting design that allows the passage of air. This feature is particularly beneficial when the drapes 40 are placed over plants. The drape support poles 41 can be extendable and retractable (variable length) and can be made of plastic, metal, or wood, or a combination thereof.

Figure 6:
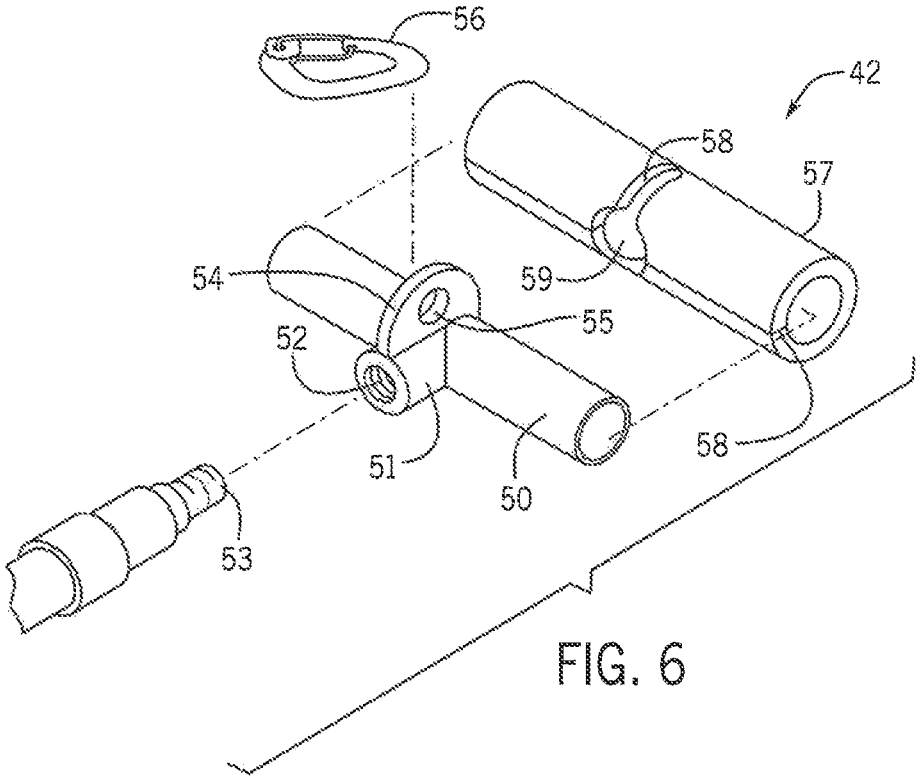
FIG. 6 shows an exploded perspective view of a pole tip support of the present invention.
Figure 7:
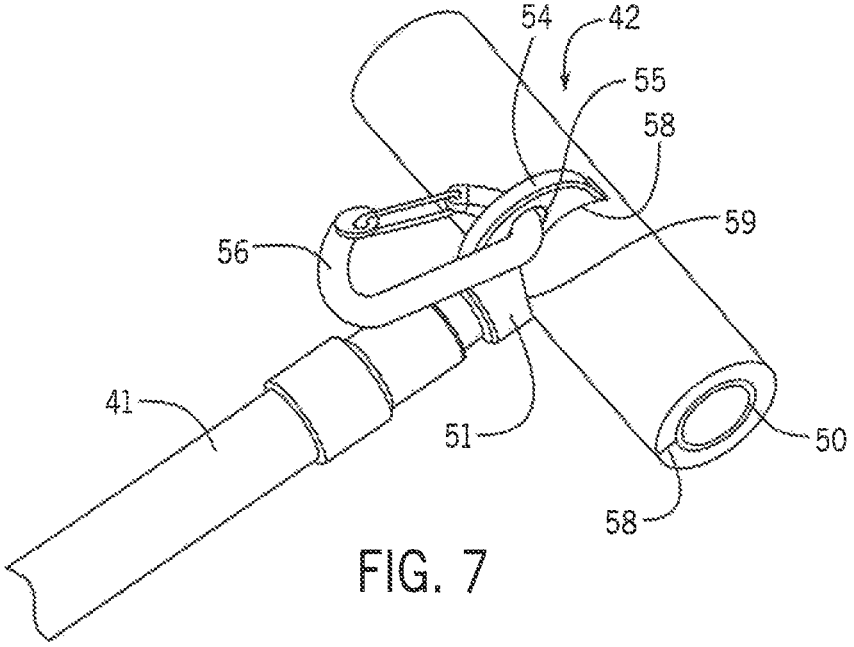
FIG. 7 shows an assembled perspective view of the pole tip support.

FIG. 6 shows an exploded perspective view of a pole tip support 42. The pole tip support 42 is, preferably, T-shaped and has a support portion 50, a pole connecting portion 51, and a debris chute drape connecting portion 54. The support portion 50 is shown as a cylinder with the cylindrical pole connecting portion 51 being oriented perpendicular to the support portion 50. The pole connecting portion 51 has internal threads 52 for connection to external threads 53 on the drape support pole 41. A drape chute connecting portion 54 extends from the support portion 50 and the pole connecting portion 51. The drape chute connecting portion 54 has a hole 55 for holding a clip 56. The clip 56 connects the debris chute drape 40 to the pole tip support 42. The clip 56 is, preferably, a carabiner. The pole tip support 42 has a protective cover 57 having slits 58 and a hole 59 so that the protective cover 57 can be reversibly placed over the support portion 50, the pole connecting portion 51, and the drape chute connection portion 54. The protective cover 51 protects against the pole tip support 42 from damaging a side of a house 43 and also helps the pole tip support 42 remain in place on the side of a house 43. FIG. 7 shows a perspective view of the pole tip support 42 in an assembled configuration with the drape support pole 41 screwed into the pole connecting portion 51 of the pole tip support 42.

Figure 8A:
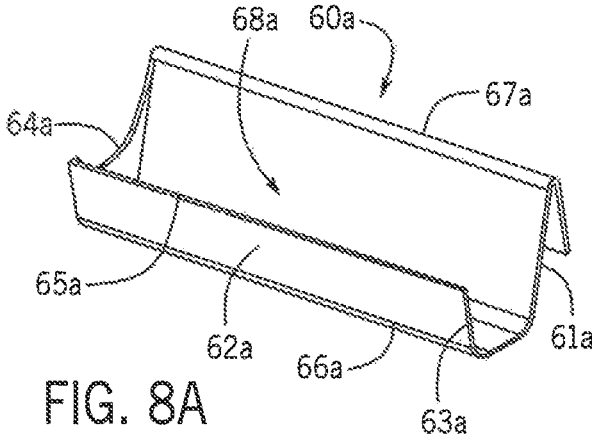
FIGS. 8*a*-8*c* show a rear perspective view of alternant embodiment of the gutter liner of FIG. 1.
Figure 8B:
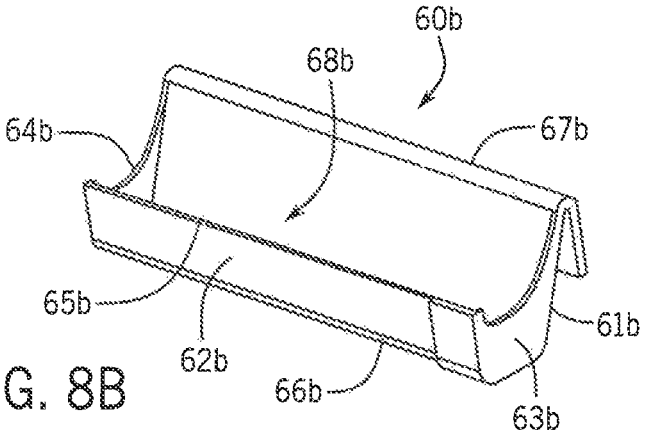
Figure 8C:
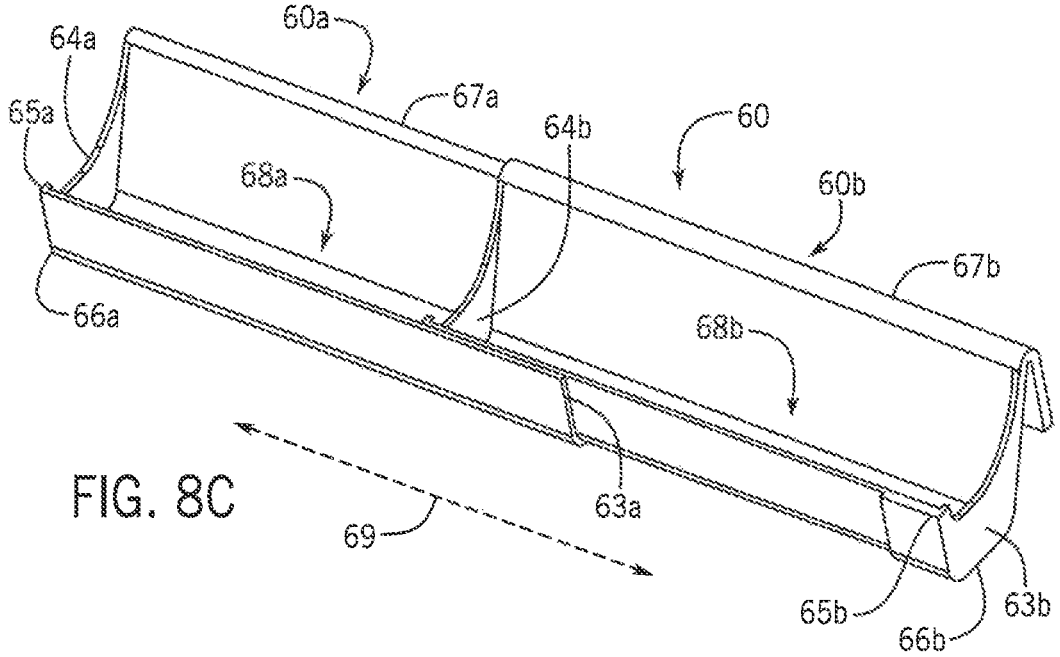

FIGS. 8*a*-8*c* show alternative embodiment gutter liner 10. FIG. 8*a* shows a first portion 60*a* and FIG. 8*b* a second portion 60*b*. As shown in FIG. 8*c* the portions 60*a* and 60*b* combine to form an adjustable gutter liner 60. The first portion 60*a* has a front side 61*a*, a rear side 62*a*, a first end 63*a*, a second opposite end 64*a*, a top 65*a*, and bottom 66*a*, a U-shaped or V-shaped lip 67*a* on the front side 61*a*, and an interior 68*a*. The second portion 60*b* has a front side 61*b*, a rear side 62*b*, a first end 63*b*, a second opposite end 64*b*, a top 65*b*, a bottom 66*b*, a U-shaped or V-shaped lip 67*b* on the front side 61*b*, and an interior 68*b*. The first end 63*a* of first portion 60*a* is open and the first end 63*b* of the second portion 60*b* is closed. FIG. 8*c* shows that the adjustable gutter liner 60 is formed when the second opposite end 64*b* of the second portion 60*b* is adjustably inserted into the interior 68*a* of the first portion 60*a* through the open first end 63*a* of the first portion 60*a*. Sections of the front side 61*b* and the rear side 62*b* of second portion 60*b* are positioned in the interior 68*a* of the first portion 60*a*. The U-shaped or V-shaped lip 67*b* of the second portion 60*b* is positioned over the U-shaped or V-shaped lip 67*a* of the first portion 60*a*. In this configuration gutter liner 60 is adjustable as the second portion 60*b* is inserted into or out of the first portion 60*a* to adjust the length of gutter liner 60 along the direction indicated by the dashed arrows 69. This adjustable feature facilitates positioning the gutter liner 60 between the mounting straps 34 in the gutter 30.

Figure 9:
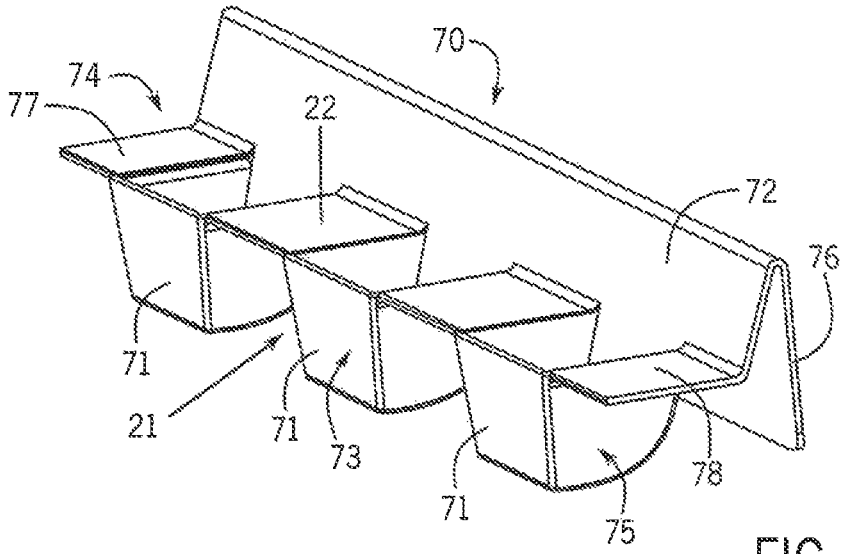
FIG. 9 shows a rear perspective view of an alternate embodiment of the gutter liner of FIG. 1.

FIG. 9 shows a rear perspective view of an alternate embodiment 70 of the gutter liner 10 shown in FIGS. 1-4. The gutter liner 70 is formed with a plurality of spaced apart roofing debris collecting cups 71. The gutter liner 70 has a front side 72, a rear side 73, a first end 74, and a second opposite end 75. A lip 76, preferably a U-shaped or V-shaped lip, extends from the front side 72 of gutter liner 70. The U-shaped or V-shaped lip 73 is constructed to fit over a front side 31 of a gutter 30 (see FIGS. 3 and 4). The gutter liner 70 has a support member 77 on the first end 74 and a support member 78 on a second opposite end 75. The support member 77 on the first end 74 of a first gutter liner 70 is constructed to fit over the support member 78 on the second opposite end 75 of second adjacent gutter liner 70, like that shown for gutter liners 10 in FIGS. 3 and 4. Spaces 21 are formed between cups 71. The cups 71 are connected to each other by covers 22 positioned over spaces 21.

Figure 10:
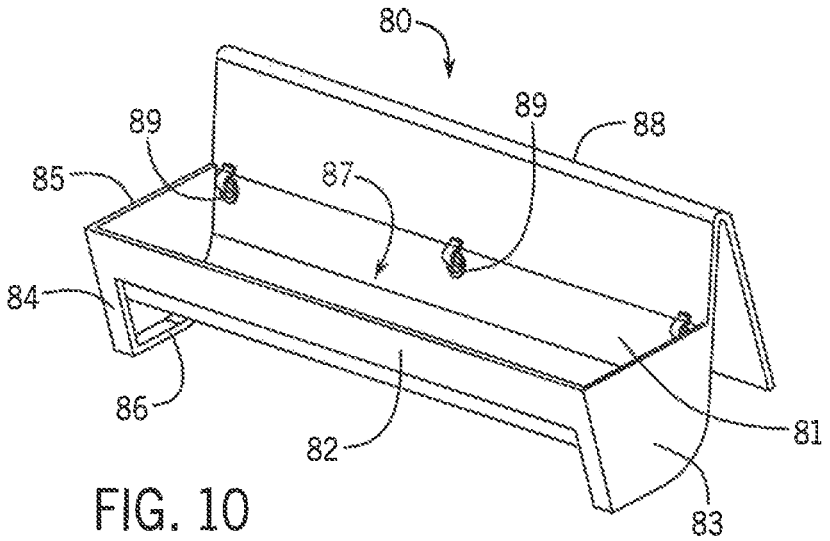
FIG. 10 is an illustration of a debris collecting ground tarp having handles attached thereto.

FIG. 10 shows a front perspective view of an alternate embodiment gutter liner 80. The gutter liner 80 has a front side 81, a rear side 82, a first end 83, a second opposite end 84, a top 85 and a bottom 86, defining an interior 87. A lip 88, preferably a U-shaped or V-shaped lip 17, extends from the front side 81 and from the top 85. One or more connectors 89, such as rings, are positioned in the interior 87 on front side 81 near top 85. The connectors 89 are useful for attaching debris chute drapes 40, for example, to the gutter liner 80, if desired.

Figure 11:
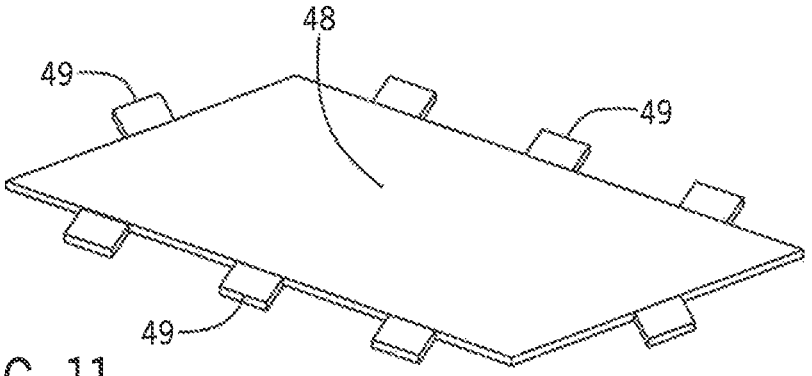
FIG. 11 shows a front perspective view of another alternate embodiment gutter liner.

FIG. 11 shows an illustration of a debris collecting ground tarp 48 having handles 49 attached thereto, preferably at the edges of the debris collecting ground tarp 48. Although the debris collecting ground tarp 48 is shown as rectangular, it can be any desired shape. The handles 49 make a fully loaded debris collecting ground tarp 48 relatively easy to carry and to empty into truck bed, for example.

Figure 12:
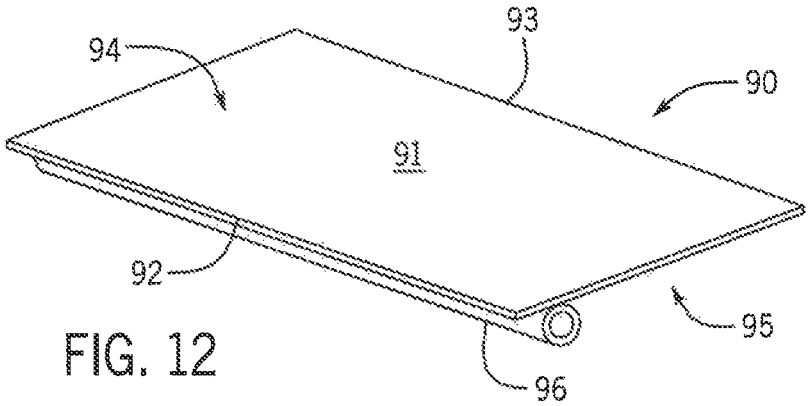
FIG. 12 shows a top perspective view of a gutter cover having a cover plate and a brace member for use adjacent to a gutter liner.

The gutter liners of the present invention can be used adjacent to a gutter cover which directs roofing debris from a roof, over a gutter, and directly onto a debris chute drape. FIG. 12 shows a top perspective view of a gutter cover 90 to direct roofing debris over a gutter 30 and onto a debris chute drape 40. The gutter cover 90 consists of a cover plate 91 having a front end 92, a rear end 93, a top surface 94, and a bottom surface 95. A brace member 96 is attached along the length of the cover plate 91 near the front end 92. The front end 92 extends beyond the brace member 96.

Figure 13:
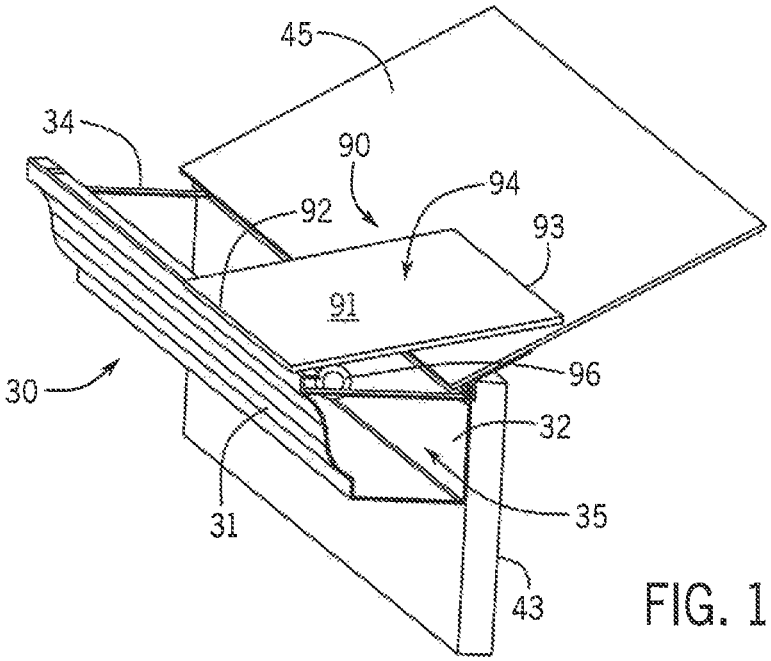
FIG. 13 shows a top perspective view of the gutter cover positioned over a gutter on a house.

FIG. 13 shows the gutter cover 90 positioned over a gutter 30 on a house 43. The brace member 96 is in the interior 35 of gutter 30 engaging the front side 31 of the gutter 30. The front end 92 of the cover plate 91 extends beyond the front side 31 of the gutter 30 and the rear end 93 of the cover plate 91 rests upon the roof 45 of the house 43. As roofing debris falls down a roof 45 onto the cover plate 91 it will fall off the front end 92 onto a debris chute drape 40.

Figure 14:
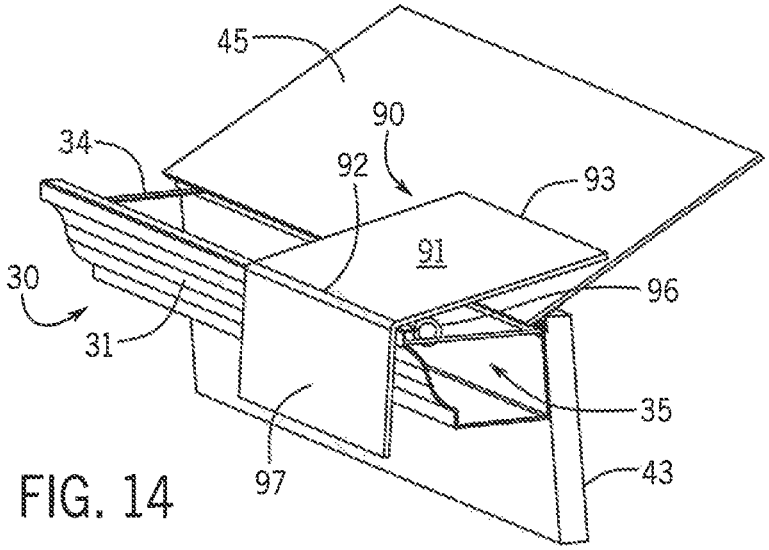
FIG. 14 shows a top perspective view of the gutter cover having a debris guide plate attached at a front end of the cover plate.

FIG. 14 shows that the gutter cover 90 can have an adjustable debris guide plate 97 attached at the front end 92 of the cover plate 91 at an angle. The angle of the guide plate 97 is optimized to further guide roofing debris from the cover plate 91 onto a debris chute drape 40.

Figure 15:
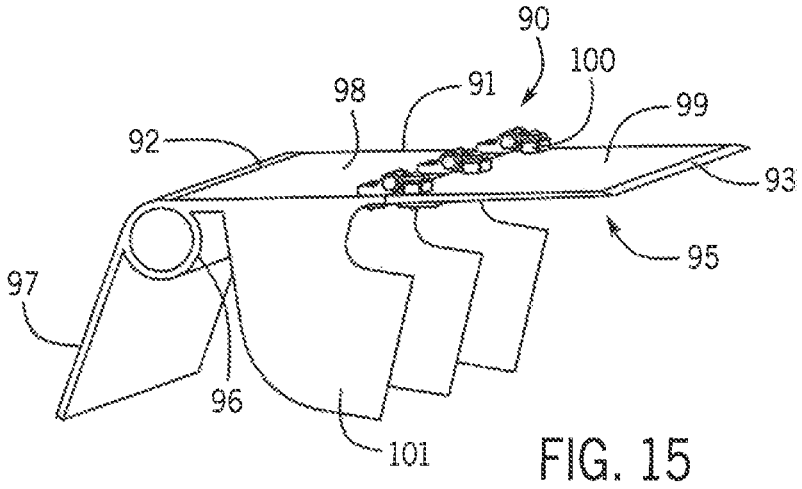
FIG. 15 shows a side perspective view of the gutter cover having a flexible cover plate and support members on its bottom surface.

FIG. 15 shows that the gutter cover 90 can have a flexible cover plate 91 to conform to the angle formed by the gutter 30 and the roof 45. The gutter cover 90 can be split into a first portion 98 and a second portion 99 connected rotatably to each other with hinges 100, for example. The gutter covers 90 can also have support members 101 on its bottom surface 95 for insertion into the interior 35 of gutter 30.

Figure 16:
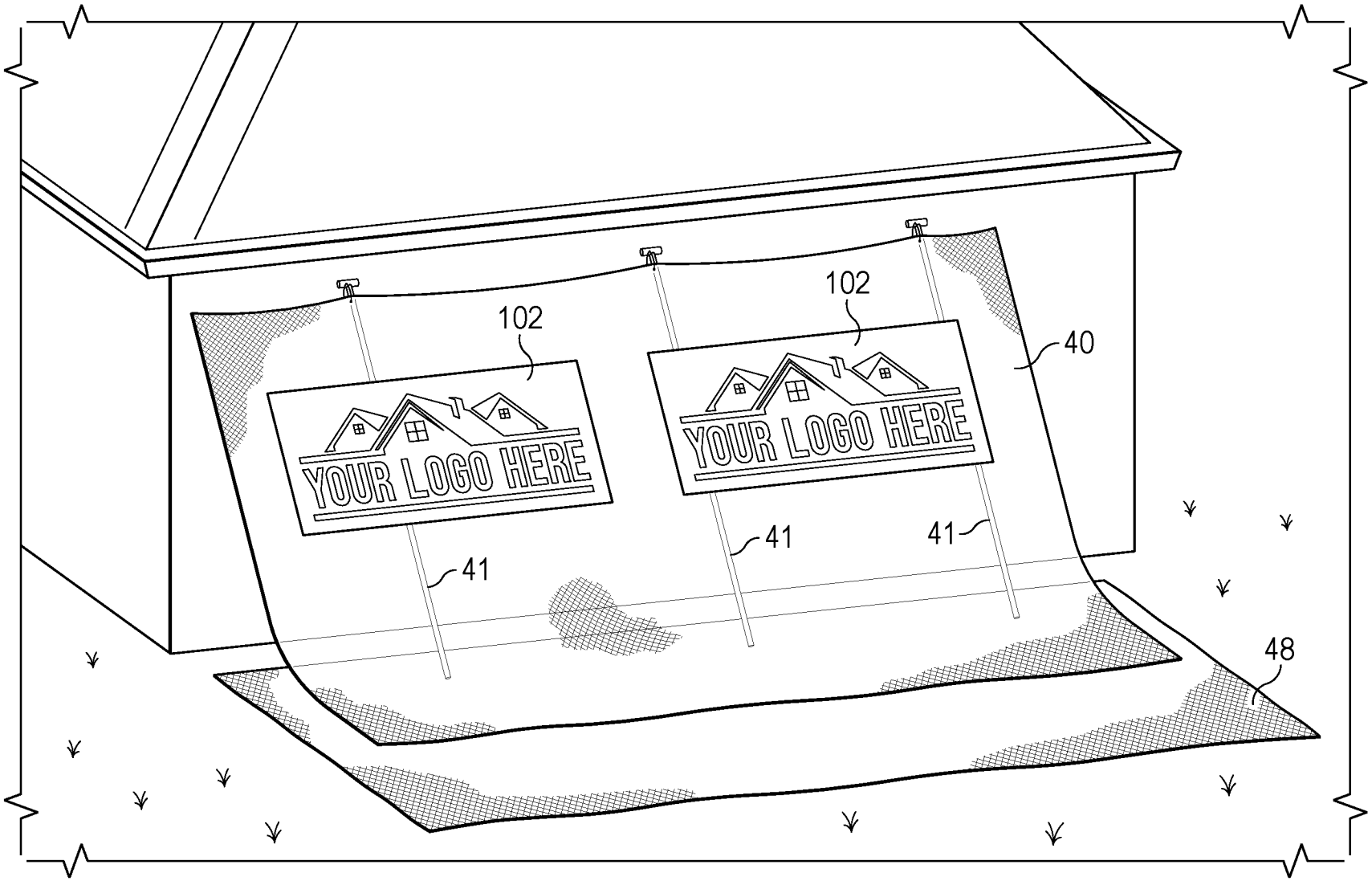
FIG. 16 shows a debris chute drape with removable signage installed.

FIG. 16 illustrates the debris chute drape 40 with removable signage 102 installed. The debris collecting ground tarp 48 may be positioned on the ground below, near, or otherwise adjacent to the debris chute drape 40. Any number, location, type, size, and shape of removeable signs 102 may be utilized. In exemplary embodiments, without limitations, the signs 102 are comprised of a water proof or water-resistant material. A front surface of the removeable sign 102 may comprise a company name, company logo, message, image, some combination thereof, or the like.

Figure 17:
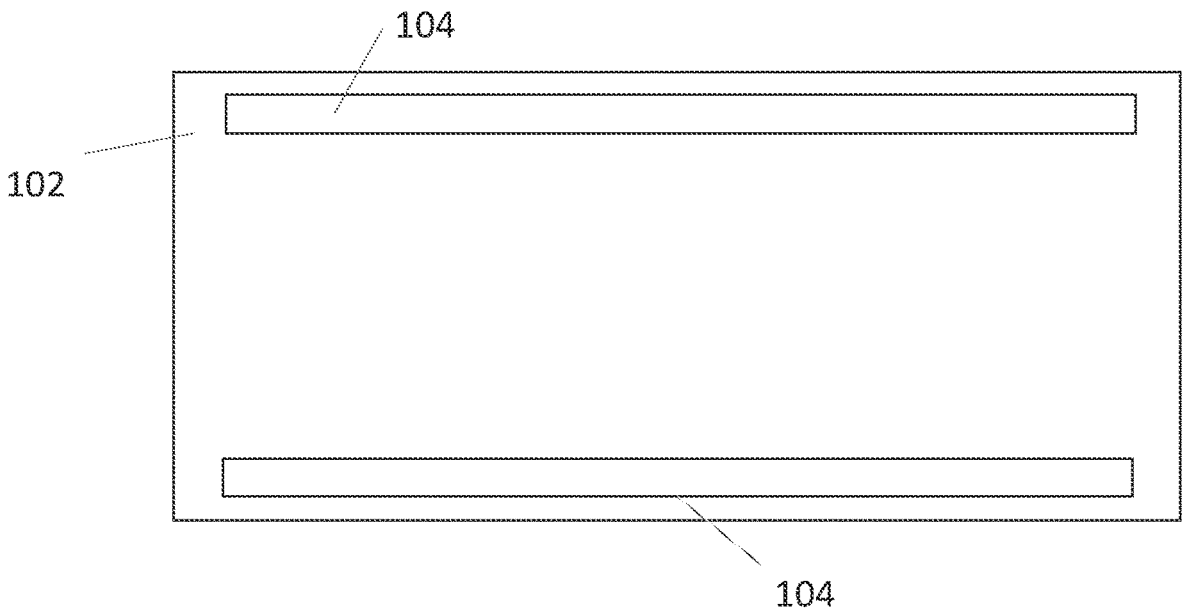
FIG. 17 shows a rear plan view of the removable signage of FIG. 16.

FIG. 17 illustrates a rear surface of an exemplary removeable sign 102. The removeable sign 102 may be provided with one or more fasteners 104. In exemplary embodiments, the fasteners 104 may comprise hook and loop fasteners, though any type of fastener may be utilized. The fasteners 104 may be provided in any size, shape, length, orientation, number, type, and the like. In exemplary embodiments, without limitation, the fasteners 104 comprise hook and loop fasteners provided in a first and second strip along an upper and lower portion of the sign 102. However, additional strips of hook and loop type fasteners may be provided at various additional locations along the rear surface of the sign 102, though such is not required. For example, without limitation, such additional strips may extend vertically and/or horizontally between the strips along the first and second strips to form a grid. Any number, location, size, shape, arrangement, and type of fasteners 104 may be utilized.

Figure 18:
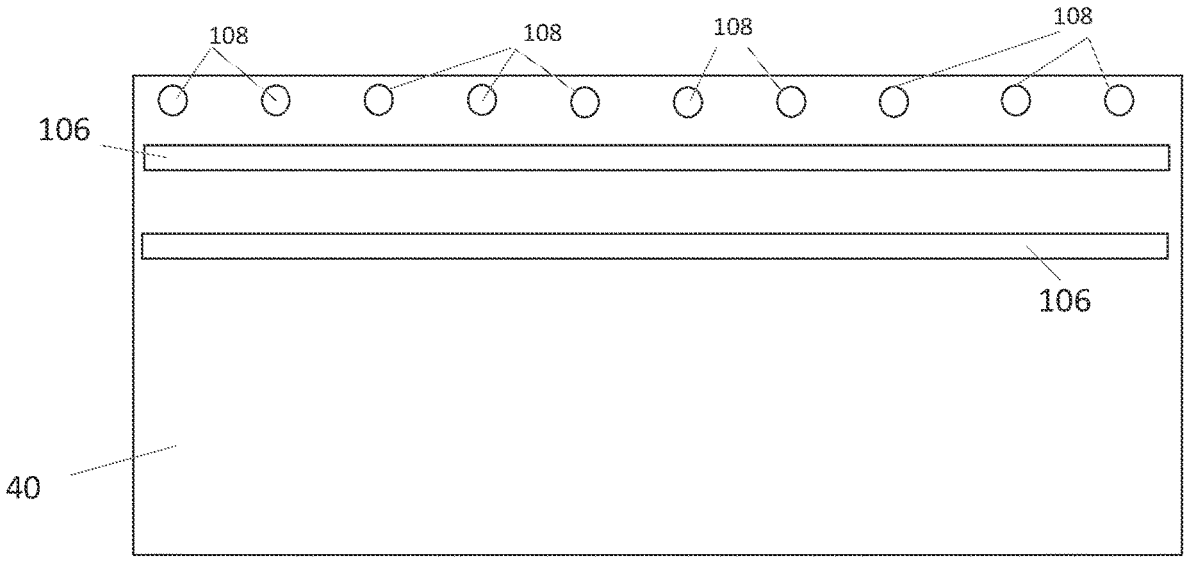
FIG. 18 shows a front plan view of the debris chute drape of FIG. 16 with the removeable signage removed.

FIG. 18 illustrates the debris chute drape 40 with the signs 102 removed. Corresponding fasteners 106 may be provided at the debris chute drape 40. The corresponding fasteners 106 may be provided at areas or other locations matching the fasteners 104 provided at the signs 102. In exemplary embodiments, without limitation, the fasteners 106 comprise hook and loop fasteners provided in strips to match the size, length, orientation, and placement of those provided at the signs 102. Any number, size, type, and location of corresponding fasteners 106 may be utilized. For example, without limitation, the fasteners 104 provided at the signs 102 may comprise only hook type fasteners while the corresponding fasteners 106 provided at the debris chute drape 40 may comprise only loop type fasteners. The reverse may be utilized. In exemplary embodiments, the corresponding fasteners 106 provided at the debris chute drape 40 may be provided in a first and second strip extending substantially, or entirely, the horizontal length of the debris chute drape 40. In such embodiments, the first and second strips may be provided on an upper half of the debris chute drape 40.

The fasteners 104 may be configured to mate with the corresponding fasteners 106. In this way, the sign(s) 102 may be prominently displayed at the job site where the debris chute drape 40 is installed. The sign(s) 102 may be removed for storage, replacement, or the like.

Holes 108 may be provided along an upper portion of some or all of the debris chute drape. The holes 108 may be defined, at least in part, by reinforced grommets, though such is not required. The drape support poles 41, or components thereof, including but not limited to the clip 56 may be configured to mate with the holes 108.

A method for collecting roofing debris includes inserting one or more gutter liners into an interior of a gutter attached to a roof; positioning one or more debris chute drapes vertically on one or more poles adjacent the gutter; allowing roofing debris to accumulate in the one or more gutter liners; allowing roofing debris to fall on to one or more debris chute drapes; allowing roofing debris to fall from the one or more debris chute drapes onto the ground; and collecting the roofing debris from the gutter liners and from the ground. The gutter liners are inserted into a gutter so that a blip on the front of the gutter liner extends over the front of the gutter. The gutter liners are arranged so that a support member on the first end of the gutter liner and the support member on the second opposite end of the gutter liner fit over a mounting strap of a gutter. Also, the support member on the first end of the gutter liner fits over the support member on the second opposite end of an adjacent gutter liner or is positioned adjacent to it.

With the alternant embodiment gutter liner 60, the two gutter liner portions 60*a* and 60*b* are combined, adjusted to the desired length, and inserted into the gutter. With the alternant embodiment gutter liner 80, it is simply inserted into the gutter and debris chute drapes can be attached to the connectors in the gutter liner 80. With the alternant embodiment gutter liner 90, it is simply inserted into the gutter. Gutter covers 90 can be used in place of gutter liners or they can be used in combination with gutter liners.

Drape support poles are placed vertically at an angle at desired intervals on the side of a building. A top end of the drape support pole is placed adjacent to the gutter on the building, beneath the gutter, and extends to the ground or to a debris collecting tarp on the ground. A bottom end of the drape support pole is placed on the ground, with the drape support pole angled away from the side of the building. Debris chute drapes are draped over the support poles and are connected to the top end of the drape support pole, preferably to a pole tip support on the top end of the drape support pole. The drape support poles angle the debris chute drapes away from the side of the building.

As roofing debris accumulates on the roof of the building it is allowed to fall down the slope of the roof into the gutter liner positioned in the interior of the gutter. The roofing debris is also allowed to fall off the roof and onto the debris chute drapes. Because the debris chute drapes are angled away from the side of the building due to the angle of the drape support poles, the roofing debris slides down the debris chute drapes and on to the ground. There is, preferably, a debris collecting tarp on the ground to collect the roofing debris from the debris chute drapes. The debris collecting ground tarp, preferably, has handles. The gutter liners with debris are collected from the gutters and the debris collecting ground tarp on the ground, with debris, is picked up. The debris in the gutter liners and on the debris collecting ground tarp is then emptied into any desired receptacle for removal. The debris chute drapes guide roofing debris away from the side of the building and, thus, protect the side of the house and objects near the side of the house from any damage that might be caused by the roofing debris.

Signage may be installed at the debris chute drape. Installation and/or removal of the signage may be performed while the debris chute drape is on the ground, though such is not required. In other exemplary embodiments, the signage may be installed and/or removed when the debris chute drape is installed at a job site. The sign(s) may be removed for storage, replacement, or the like. The sign(s) may be installed by aligning hook and loop fasteners provided at the debris chute drape and at the sign(s) and applying compressive forces. The sign(s) may be removed by applying pressure to pull the sign away from the debris chute drape.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the gutter liners can made in any size and from any suitable materials. The drape support poles can be constructed in any size and strength and be connected by any suitable means to a pole tip support. The debris chute drapes can be of any suitable size and material and can be flexible or inflexible. The roofing debris collecting apparatus of the present invention can be adapted to any type of roof and building.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

It will be understood that various changes in the details, materials, and arrangements of the parts which have been described and illustrated above in order to explain the nature of this invention may be made by those skilled in the art without departing from the principle and scope of the invention as recited in the following claim.

What is claimed is:

1. A system for collecting roofing debris comprising:

a debris collection chute comprising netting and a plurality of attachment points spaced apart along an upper edge of the debris collection chute;

a plurality of support poles, each comprising a lower end configured to rest against a ground surface, a pole tip support located at an upper end and extending outward from a longitudinal axis of an associated one of the plurality of support poles, and an attachment device at said upper end configured to selectively mate with one of the plurality of attachment points of said debris collection chute to suspend said debris collection chute in a primarily vertical orientation at an angle from a wall of a structure being serviced; and a plurality of putter liners configured to fit within a gutter located at or adjacent to the wall;

wherein said netting is configured to prevent said roofing debris above a predetermined size from traveling therethrough while permitting airflow and water to pass through the netting.

2. The system of claim 1 further comprising:

a plurality of fasteners located at said debris collection chute; and a removeable sign comprising a plurality of corresponding fasteners arranged configured to mate with the plurality of fasteners at the debris collection chute.

3. The system of claim 2 wherein:

said fasteners comprise hook and loop fasteners;

said corresponding fasteners comprise hook and loop fasteners;

said corresponding fasteners are provided in strips located about a perimeter of the removable sign; and said fasteners are provided in strips of size, length, and location matching those of the corresponding fasteners.

4. The system of claim 1 wherein:

each of said attachment devices comprises a clip;

each of said plurality of attachment points comprise pre-formed holes spaced apart along an upper edge of said netting;

each of said pre-formed holes comprise at least one reinforcing grommet;

each of said clips of said plurality of attachment devices comprise carabiners configured for connection with said holes;

the pole tip supports of each of said plurality of support poles extend in a lateral direction to provide lateral stability to the associated one of the plurality of support poles when placed against said wall; and each of said carabiners are located at the pole tip supports of the plurality of support poles.

5. The system of claim 1 wherein:

each of said plurality of gutter liners comprise a front edge configured to extend over a front edge of the gutter to protect a front face of the gutter;

each of said plurality of gutter liners comprise a plurality of debris collection cups configured to extend within said gutter when the plurality of gutter liners are installed at the gutter.

6. The system of claim 1 further comprising:

a ground collection tarp configured for placement along said ground surface adjacent to said wall.

7. The system of claim 6 further comprising:

a plurality of handles spaced apart along a perimeter of said ground collection tarp.

8. The system of claim 1 wherein:

a portion of said support poles extending between said lower end and said pole tip support comprise a unitary member or multiple members configured for manual, telescoping movement to statically secure said multiple members relative to one another without otherwise imparting external forces such that said support poles are configured to freely rest against an upward extending portion of a wall of a structure being serviced in an otherwise unloaded state.

9. A method for collecting roofing debris comprising:

resting lower portions of support poles against an outdoor ground surface;

mating upper portions of said support poles to attachment points spaced apart along an upper edge of a debris collection chute comprising netting configured to prevent said roofing debris above a predetermined size from traveling therethrough while permitting airflow and water to pass through the netting;

freely resting upper portions of said support poles against upwardly extending portions of one or more external walls of a structure being serviced adjacent to a roof of said structure such that said debris collection chute is suspended in a primarily vertical orientation at an angle away from the one or more walls so as to form a ramped surface, wherein said support poles are secured against said external walls in an otherwise unloaded state; and depositing roofing debris from the roof within the debris collection chute such that said roofing debris travel down the debris collection chute and away from the structure.

10. The method of claim 9 further comprising the steps of:

placing a debris collection tarp along the ground surface adjacent to a lower portion of said debris collection chute such that debris deposited within the debris collection chute are moved to said debris collection tarp for collection;

folding said debris collection tarp to capture said debris; and removing said folded debris collection tarp from a job site.

11. The method of claim 10 further comprising the step of:

placing gutter liners within a gutter located along said one or more walls;

removing said gutter liners; and depositing debris collected within said gutter liners within said debris collection chute.

12. The method of claim 9 wherein:

each of the upper portions of said support poles comprise pole tip supports which extend outward from longitudinal axes of the support poles;

each of said attachment points comprise a pre-formed hole; and each of said support poles comprise carabiners which are configured for connection with said holes to secure said support poles to said debris collection chute.

13. The method of claim 9 further comprising the steps of:

attaching signage to the debris collection chute; and removing said signage from the debris collection chute.

14. The method of claim 13 wherein:

said signage is attached to said debris collection chute in a removable fashion by way of fasteners located at said debris collection chute and corresponding fasteners located at said removeable signage;

said corresponding fasteners comprise strips of hook and loop fastener provided about a perimeter of said removeable signage;

said fasteners comprise strips of hook and loop fasteners matching the length and placement of said corresponding fasteners; and said removeable signage is attached to, and removed from, said debris collection chute prior to suspending said debris collection chute in said vertical orientation.

15. A method for collecting roofing debris comprising:

applying a logo or mark to a secondary layer of a debris collection chute;

attaching the secondary layer to a primary layer of a debris collection chute, wherein said primary layer is configured to capture the roofing debris deposited from a roof of onto the debris collection chute;

securing the debris collection chute with the primary layer and attached secondary layer to an associated structure where a roofing job is being performed such that said debris collection chute is angled away from said associated structure to form a ramped surface; and depositing roofing debris from the associated structure onto the debris collection chute so that said roofing debris moves down the debris collection chute and away from said associated structure.

16. The method of claim 15 further comprising the steps of:

providing a ground collection tarp adjacent to the debris collection chute for further collection of said deposited roofing debris;

folding the ground collection tarp to capture the deposited roofing debris;

depositing the collected roofing debris into a waste receptacle; and reusing the debris collection chute and ground collection tarp at another structure for another roofing job.

17. The method of claim 15 wherein:

the logo or mark is applied by printing;

the primary layer comprises a flexible netting configured to prevent said roofing debris above a predetermined size from traveling therethrough while permitting airflow and water to pass through the netting;

the secondary layer comprises a solid, opaque material; and the secondary layer is removably attached to the primary layer by way of hook and loop fasteners.

* * * * *